US005990764A

United States Patent [19]

Tanizaki et al.

[11] Patent Number: 5,990,764

[45] Date of Patent: Nov. 23, 1999

[54] DIELECTRIC WAVEGUIDE WITH AT LEAST ONE DIELECTRIC RESONATOR AND A PLURALITY OF DIELECTRIC STRIPS COUPLED WITH SAID AT LEAST ONE RESONATOR

[75] Inventors: Toru Tanizaki, Kyoto; Hiroshi Nishida, Kawanishi; Atsushi Saitoh, Nagaokakyo, all of Japan

[73] Assignee: Murata Manufacturing Co., Ltd., Japan

[21] Appl. No.: 09/012,686

[22] Filed: Jan. 23, 1998

[30] Foreign Application Priority Data

Jan. 23, 1997 [JP] Japan ..... 9-010137

[51] Int. Cl.[6] ..... H01P 7/10; H01P 3/16

[52] U.S. Cl. ..... 333/202; 333/219.1; 333/239; 333/248

[58] Field of Search ..... 333/202, 219.1, 333/208, 230, 237, 239, 248

[56] References Cited

U.S. PATENT DOCUMENTS 5,473,296 12/1995 Ishikawa et al. ..... 333/239

5,861,782 1/1999 Saitoh ..... 333/239

FOREIGN PATENT DOCUMENTS 63-185101 7/1988 Japan ..... 333/239

8-65004 3/1996 Japan ..... 333/239

OTHER PUBLICATIONS

Xu et al., "Scattering properties of discontinuities in NRD guide", 8049h IEE Proceedings–H: Microwave Antennas and Propagation, pp. 205–210, Jun. 1994.

Di Nallo et al., "Experimental Investigation on NRD–guide Dual–Mode Filters", IEEE MTT–S Inter. Microwave Symposium Digest, vol. 1, pp. 237–240, May 1994.

*Primary Examiner*—Seungsook Ham

*Attorney, Agent, or Firm*—Ostrolenk, Faber, Gerb & Soffen, LLP

[57] ABSTRACT

An intersect-line apparatus has two conductor plates. An HE-mode dielectric resonator and four dielectric strips to be coupled to the resonator are disposed between the two conductor plates. The adjacent four dielectric strips are spaced from each other substantially at 90 degrees. Accordingly, signals propagating in two strip lines positioned substantially at 180 degrees and signals propagating in the remaining two strip lines cross each other within the dielectric resonator without interfering with each other.

13 Claims, 10 Drawing Sheets

DIELECTRIC WAVEGUIDE WITH AT LEAST ONE DIELECTRIC RESONATOR AND A PLURALITY OF DIELECTRIC STRIPS COUPLED WITH SAID AT LEAST ONE RESONATOR

BACKGROUND OF THE INVENTION

1. Field of the Invention

The present invention relates to a dielectric line apparatus and, more particularly, to a dielectric intersect-line apparatus in which a dielectric resonator is disposed at the intersecting portion of the lines.

2. Description of the Related Art

Dielectric lines through which electromagnetic waves propagate along dielectric strips inserted between two parallel conductors are used in a dielectric line apparatus in a microwave or a millimeter band. The above type of dielectric line apparatus is configured in, for example, the following manner. Components, such as an oscillator, a circulator, and a mixer, are formed into modules, which are then disposed at predetermined positions, thereby forming an integrated circuit. Alternatively, several circuit elements are integrally provided between two conductor plates, thereby forming an integrated circuit.

Whichever structure the dielectric line apparatus has, in order to miniaturize the overall apparatus, it is important to design the apparatus to achieve the optimal routing of the dielectric lines by suitably locating the individual modules, since the dielectric lines are disposed substantially in the same plane. This may be achieved by designing the arrangement of electronic components and wiring patterns on a circuit board in the following manner. Wiring patterns are positioned to cross each other if necessary. Dielectric lines through which electromagnetic waves propagate in different directions are also located to intersect each other, thereby efficiently integrating the components in a limited space.

For example, an intersect-line apparatus may be formed, as shown in FIG. 12, by using a cross-shaped dielectric strip. In FIG. 12, a cross-shaped dielectric strip 3 is inserted between conductor plates 1 and 2 so that electromagnetic waves propagate through the dielectric strip 3 in two intersecting directions.

However, by merely using a cross-shaped dielectric strip in the above manner, non-continuous portions are generated in the dielectric lines, thereby failing to achieve matching and increasing the reflection at the intersecting portion. Accordingly, the above type of dielectric line apparatus is not suitable for use where low reflection-characteristics are demanded. Further, by merely using a cross-shaped dielectric strip, mode conversion disadvantageously occurs in the intersecting portion, and signals are transmitted in different modes at the intersecting portion of the dielectric strip from one line to the other line.

SUMMARY OF THE INVENTION

Accordingly, it is an object of the present invention to provide an intersect-line apparatus using intersecting dielectric lines in which reflection of signals at the intersecting portion of the lines is inhibited and the intersecting lines do not influence each other.

In order to achieve the above object, according to the present invention, there is provided an intersect-line apparatus comprising two conductor plates disposed substantially parallel to each other. One HE-mode dielectric resonator or a plurality of HE-mode dielectric resonators connected to each other are disposed between the two conductor plates. Four dielectric strips with end portions facing the HE-mode dielectric resonator or a predetermined dielectric resonator of the plurality of dielectric resonators are provided. The adjacent dielectric resonators are spaced from each other at an angle of substantially 90 degrees.

With this arrangement, the HE-mode dielectric resonator is disposed between one pair of dielectric strips positioned substantially at 180 degrees. An LSM-mode electromagnetic wave propagating in one of the pair of dielectric strips excites the dielectric resonator in the HE mode and further propagates in the other dielectric strip. Similarly, the HE-mode dielectric resonator is disposed between the other pair of dielectric strips positioned substantially at 180 degrees. An LSM-mode electromagnetic wave propagating in one of the pair of dielectric strips excites the dielectric resonator in the HE mode and further propagates in the other dielectric strip. Accordingly, each of the dielectric strips is coupled to the dielectric resonator, thereby forming an intersect-line apparatus in which two dielectric lines intersect each other with low reflection- characteristics.

Moreover, in the foregoing intersect-line apparatus, an LSE-mode suppressor may be provided for each of the four dielectric strips. This makes it possible to inhibit an LSE-mode signal from propagating in the 90°-spaced intersecting lines, thereby preventing mode conversion between the two intersecting dielectric lines. As a consequence, the two lines are used as independent (isolated) lines.

Further, in the foregoing intersect-line apparatus, a spacing between the two conductor plates in a propagating region where the dielectric strips are disposed, a spacing between the two conductor plates in a non-propagating region outside the propagating region, a dielectric constant of the propagating region, and a dielectric constant of the non-propagating region may be determined under conditions that the cut-off frequency of an $LSM_{01}$-mode signal propagating in the propagating region may be lower than the cut-off frequency of an $LSE_{01}$-mode signal, and that electromagnetic waves in the $LSM_{01}$ mode and the $LSE_{01}$ mode may be interrupted.

In the above dielectric lines, only a single-mode signal, i.e., an $LSM_{01}$-mode signal, propagates. Accordingly, mode conversion between the two intersecting dielectric lines can be prevented without needing to provide LSE-mode suppressors, thereby ensuring isolation between the two dielectric lines. As a consequence, the two lines are used as independent (isolated) lines.

DESCRIPTION OF THE PREFERRED EMBODIMENTS

The configuration of an intersect-line apparatus according to a first embodiment of the present invention is described below with reference to FIGS. 1 through 6.

Figure 1A:
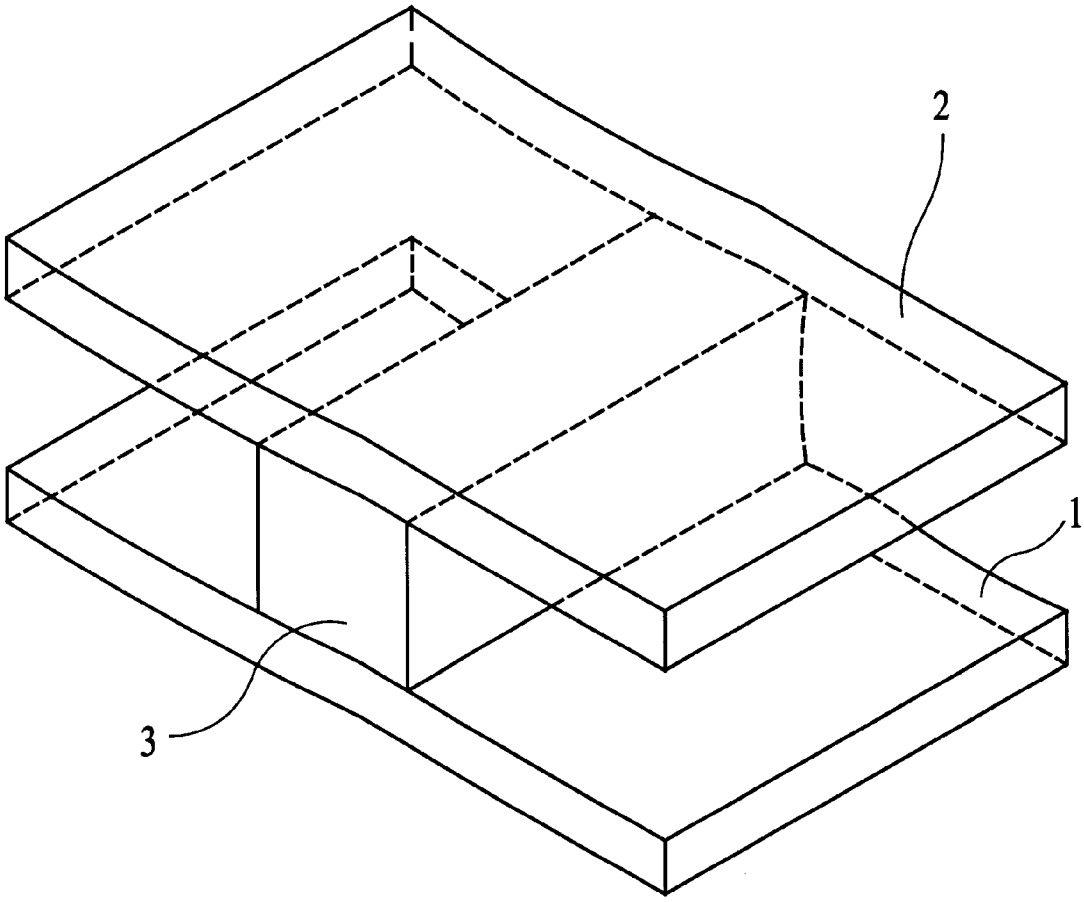
FIGS. 1A and 1B are respectively a partial perspective view and a sectional view illustrating the configuration of dielectric lines used in an intersect-line apparatus according to a first embodiment of the present invention.
Figure 1B:
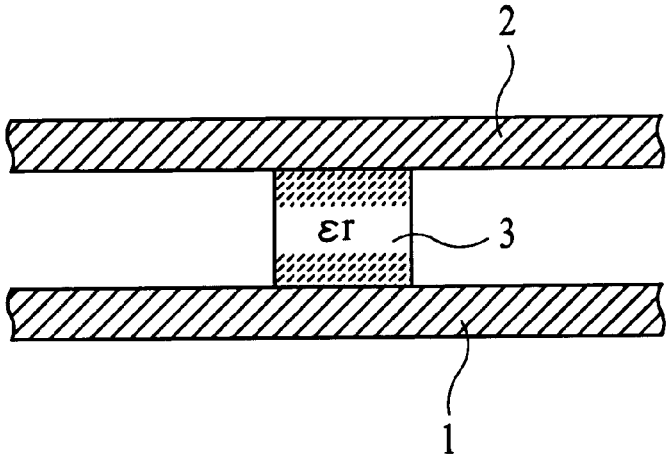

FIG. 1A is a partial perspective view illustrating dielectric lines used in an intersect-line apparatus, and FIG. 1B is a sectional view of the dielectric lines shown in FIG. 1A. In FIGS. 1A and 1B, the intersect-line apparatus has two conductor plates 1 and 2 and a dielectric strip 3 inserted between the two plates 1 and 2.

Figure 2A:
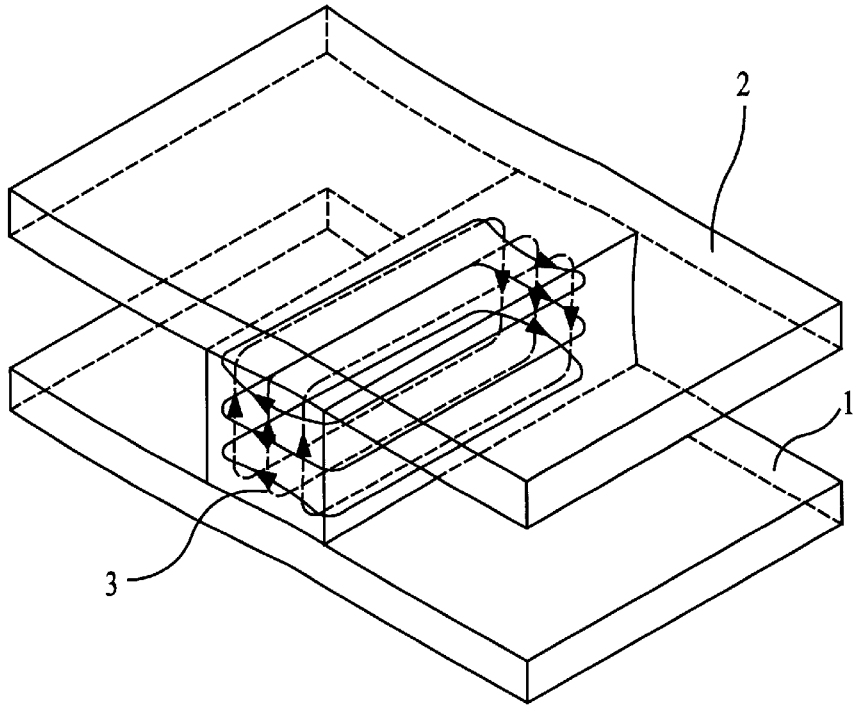
FIG. 2A and 2B respectively illustrate two modes used in the dielectric lines shown in FIGS. 1A and 1B.
Figure 2B:
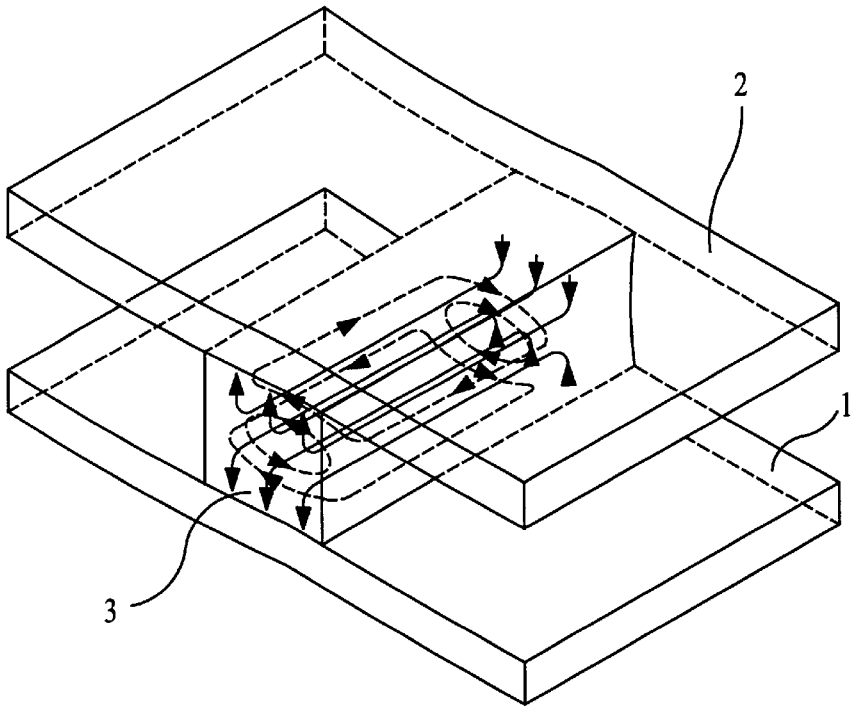

FIG. 2A illustrates the electromagnetic distribution in the $LSM_{01}$ mode, while FIG. 2B illustrates the electromagnetic distribution in the $LSE_{01}$ mode. In FIGS. 2A and 2B, the solid lines indicate the electric-field distribution, while the broken lines indicate the magnetic-field distribution.

Figure 3A:
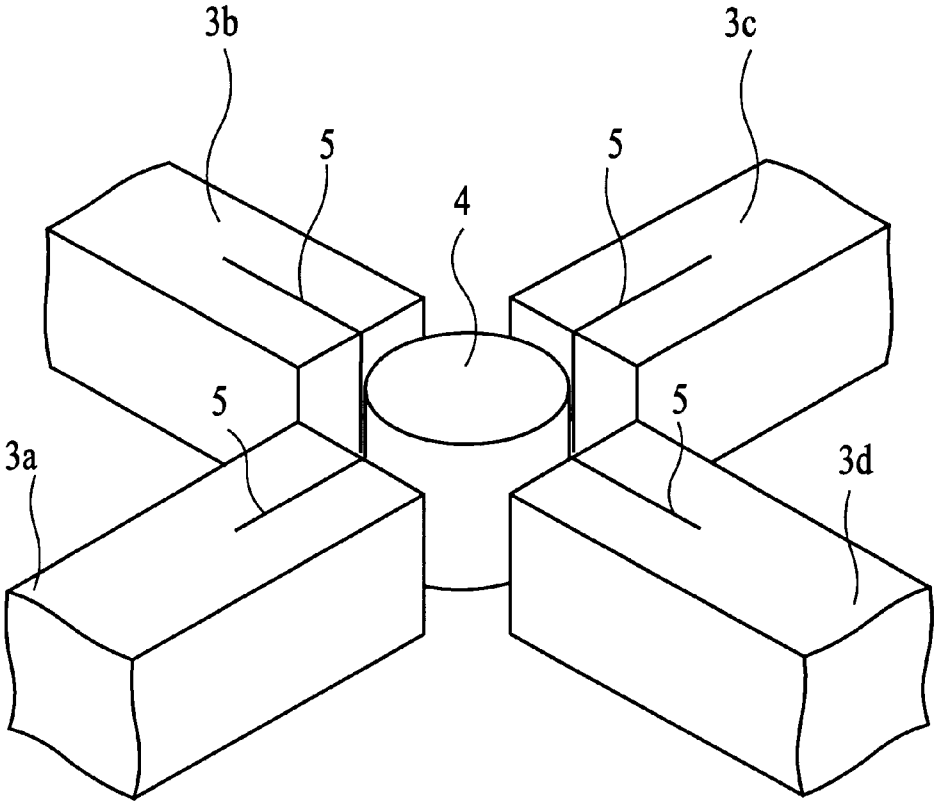
FIGS. 3A and 3B are respectively a perspective view and a sectional view illustrating the configuration of the intersect-line apparatus shown in FIGS. 1A and 1B.
Figure 3B:
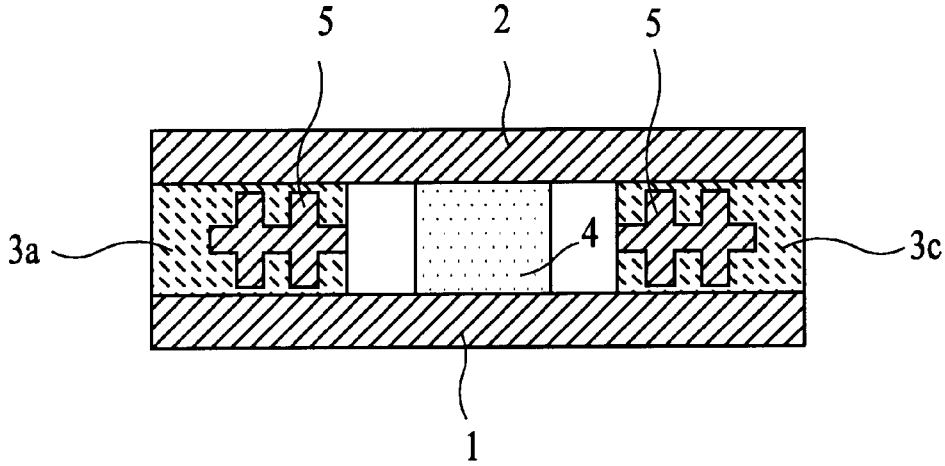

FIG. 3A is a partial perspective view of the essential portion of the intersect-line apparatus (upper and lower conductor plates 1 and 2 are not shown), and FIG. 3B is a sectional view of the essential portion shown in FIG. 3A. A dielectric resonator 4 resonating in the $HE_{111}$ mode is provided between the conductor plates 1 and 2, and four dielectric strips 3*a* through 3*d* are disposed around the dielectric resonator 4 in such a manner that the adjacent dielectric strips are spaced from each other at 90°. Moreover, a mode suppressor 5 for suppressing the propagation of the $LSE_{01}$ mode is provided at the respective end of each of the dielectric strips 3*a* through 3*d* that is closer to the dielectric resonator 4. The mode suppressor 5 is formed, as shown in FIG. 3B, by providing a conductor member within each of the dielectric strips 3*a* through 3*d* in directions parallel to the dielectric strips 3*a* through 3*d* and perpendicular to the conductor plates 1 and 2, and inhibits the LSE mode signals from propagating in the dielectric strips 3*a* through 3*d*.

Figure 4A:
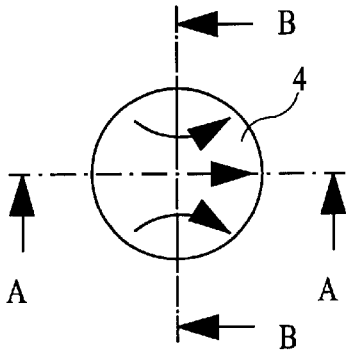
FIG. 4A is a plan view illustrating an example of excitation modes of a dielectric resonator used in the intersect-line apparatus shown in FIGS. 1A and 1B.
Figure 4B:
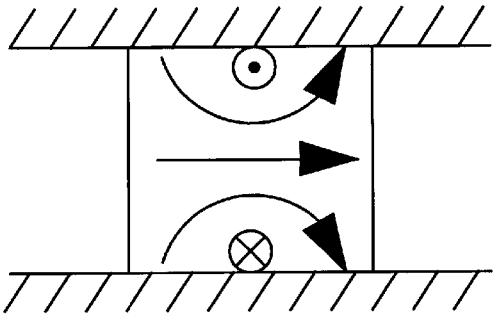
FIG. 4B is a cross-section taken along line A—A in FIG. 4A.
Figure 4C:
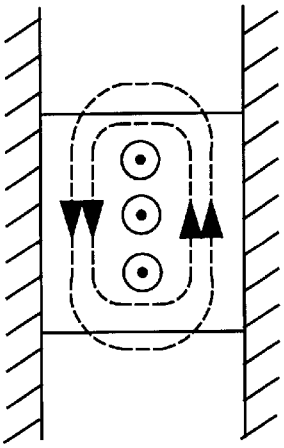
FIG. 4C is a cross-section taken along line B—B in FIG. 4B.

FIGS. 4A–4C illustrate an example of excitation modes of the dielectric resonator 4. In FIGS. 4A–4C, the solid lines indicate the electric field, while the broken lines represent the magnetic field. In this example, the dielectric resonator 4 is excited in the $HE_{111}$ mode, and the resonant frequency is tuned to a frequency band of an electromagnetic wave to propagate in the dielectric lines. Accordingly, the dielectric resonator 4 is magnetically coupled to the $LSM_{01}$ mode or electrically coupled to the $LSE_{01}$ mode of an adjacent dielectric line. In this embodiment, however, the $LSE_{01}$ mode is treated as an unwanted mode, as described below. The dielectric resonator 4 is designed with the following conditions in order to resonate in the $HE_{111}$ mode at a frequency of 60 GHz.

More specifically, in forming a dielectric material having a relative dielectric constant $\epsilon r$ of 2.04 into a cylindrical dielectric resonator, the dimensions of the dielectric resonator are determined as follows. The height of the dielectric material shall be indicated by h, and the diameter shall be represented by D. When the height h is 2.25 mm, the diameter D is set to be 2.8 mm. Moreover, when the height h is 2.2 mm, the diameter D is set to be 3.0 mm. If the diameter D is determined to be 4.9 mm when the height h is 2.25 mm, the dielectric resonator 4 resonates in the $TE_{011}$ mode. If the diameter D is determined to be 5.2 mm when the height h is 2.2 mm, the dielectric resonator 4 resonates in the $TE_{011}$ mode.

Figure 5:
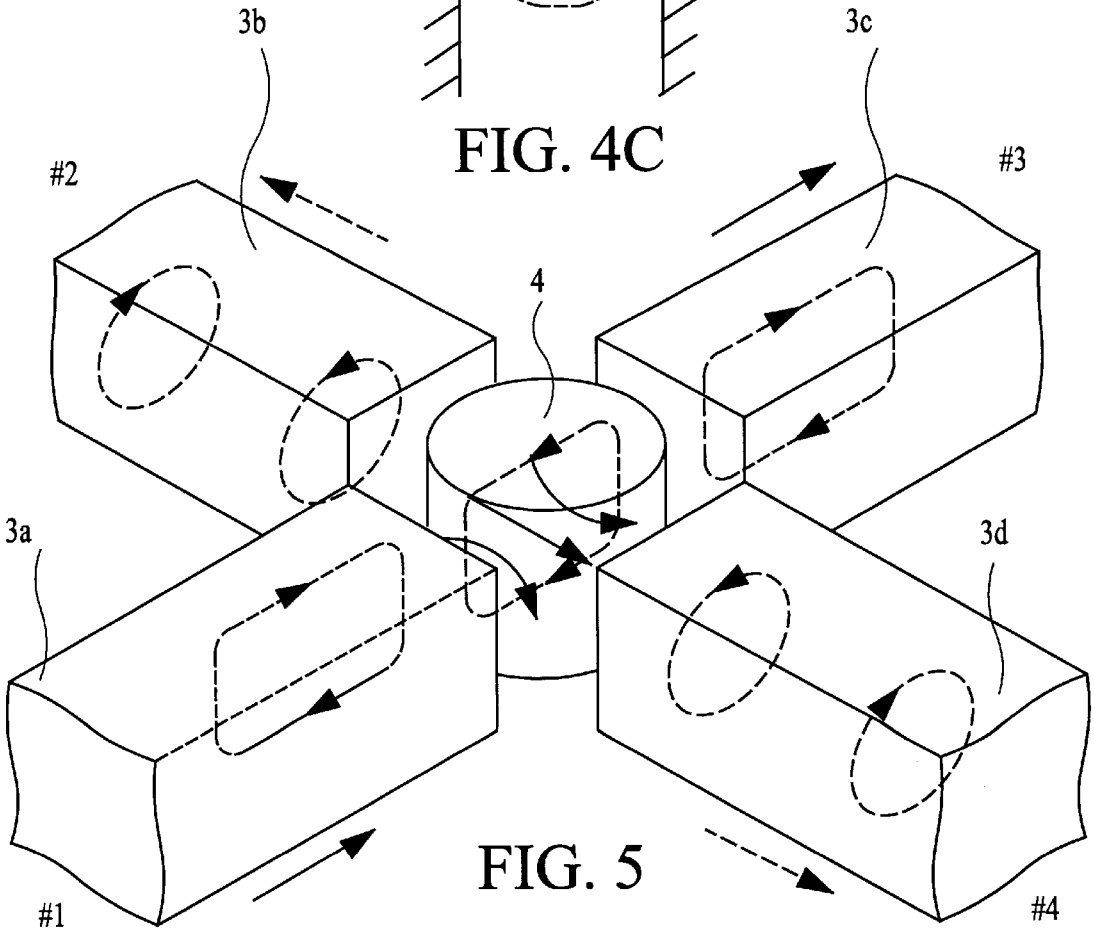
FIG. 5 is a perspective view illustrating the coupling state between the dielectric strips and the dielectric resonator used in the intersect-line apparatus illustrated in FIGS. 1A and 1B.
Figure 6A:
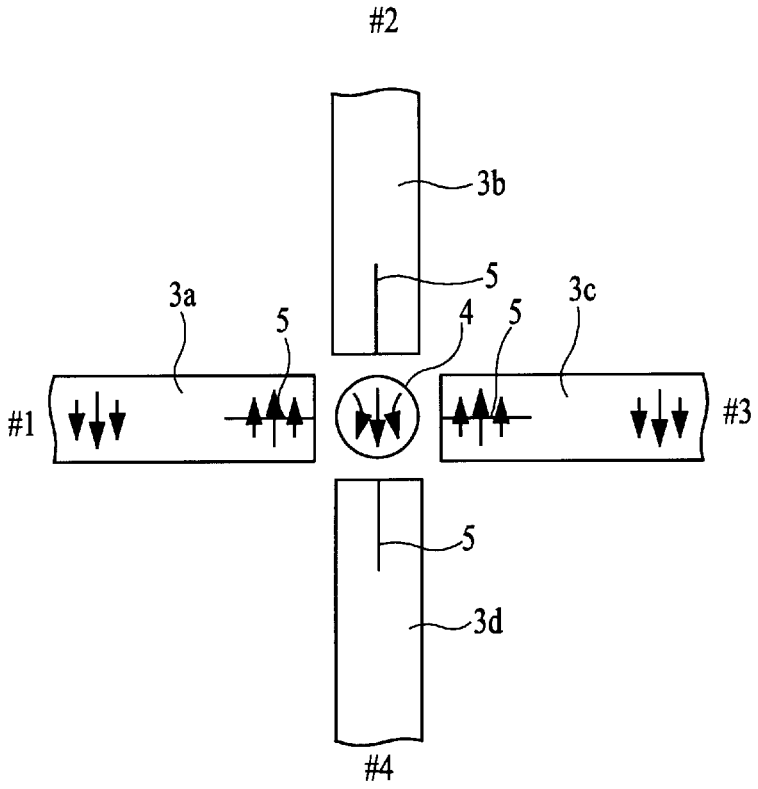
FIGS. 6A and 6B are plan views illustrating the coupling state between the dielectric strips and the dielectric resonator used in the intersect-line apparatus shown in FIGS. 1A and 1B.
Figure 6B:
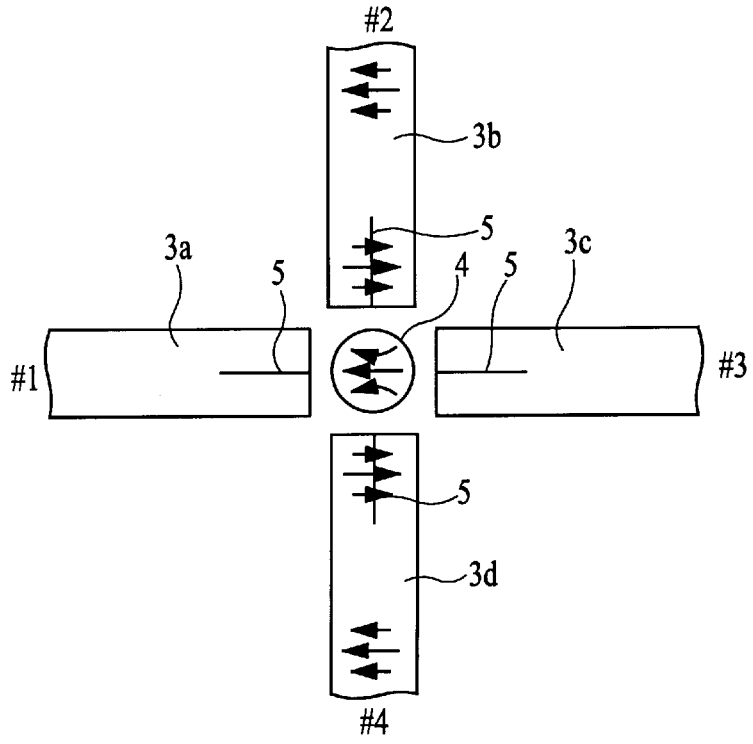

FIG. 5 illustrates the coupling state between the individual dielectric strips 3*a* through 3*d* and the dielectric resonator 4. FIG. 6A illustrates the coupling state between the dielectric strips 3*a* through 3*d* and the dielectric resonator 4 particularly by referring to the electric-field components. An electromagnetic wave in the $LSM_{01}$ mode is incident on the dielectric strip 3*a* from a port #1, as illustrated in FIGS. 5 and 6A, so that the dielectric strip 3*a* is magnetically coupled to the dielectric resonator 4, which is then excited in the $HE_{111}$ mode. The dielectric resonator 4 is then magnetically coupled to the dielectric strip 3*c*, thereby outputting an electromagnetic wave in the $LSM_{01}$ mode from a port #3. At this time, an electromagnetic wave in the $LSE_{01}$ mode is induced to propagate in the dielectric strips 3*b* and 3*d*. As illustrated in FIG. 6A, however, the LSE mode suppressors 5 provided for the dielectric strips 3*b* and 3*d* suppress the $LSE_{01}$ mode signals from reaching ports #2 and #4, respectively. Conversely, when an electromagnetic wave in the $LSM_{01}$ mode is incident on the dielectric strip 3*b* from the port #2, as shown in FIG. 6B, the dielectric strip 3*b* is magnetically coupled to the dielectric resonator 4, which is then excited in the $HE_{111}$ mode. The dielectric resonator 4 is then magnetically coupled to the dielectric strip 3*d*, thereby outputting an electromagnetic wave in the $LSM_{01}$ mode from the port #4. At this time, an electromagnetic wave in the $LSE_{01}$ mode is induced to propagate in the dielectric strips 3*a* and 3*c*. The LSE mode suppressors 5 provided for the dielectric strips 3*a* and 3*c* inhibit the $LSE_{01}$ mode signals, as illustrated in FIG. 6B, from reaching the ports #1 and #3, respectively.

In the embodiment shown in FIG. 6A and 6B, the adjacent dielectric strips 3*a* through 3*d* are spaced from each other at 90°. Even a slight amount of displacement of the angle between the adjacent dielectric strips from 90° causes leakage of the $LEM_{01}$ mode into the intersecting line, thereby lowering the isolation between the intersecting lines. However, the angle between the adjacent dielectric strips 3*a* through 3*d* may be displaced from 90° as long as the resulting isolation is negligible.

Moreover, a tubular $HE_{111}$-mode dielectric resonator may be used, which is operated in a manner similar to the above cylindrical $HE_{111}$-mode dielectric resonator.

Further, the end faces of the dielectric strips should be placed symmetrically with respect to the direction in which electromagnetic waves propagating in the dielectric strips are headed. Namely, the end faces of the dielectric strips may be configured in any shape as long as signals are effectively transmitted from the dielectric strip 3*a* to the dielectric strip 3*c* via the dielectric resonator 4 (or in the reverse direction) and from the dielectric strip 3*b* to the dielectric strip 3*d* via the dielectric resonator 4 (or in the reverse direction).

The dielectric strips may be bent as required. In short, it is only essential that the end faces of the dielectric strips 3*a*, 3*b*, 3*c* and 3*d* opposedly face the dielectric resonator 4 in such a manner that the signals propagating in the dielectric strips 3*a* and 3*c* do not interfere with the signals propagating in the dielectric strips 3*b* and 3*d*.

Figure 7A:
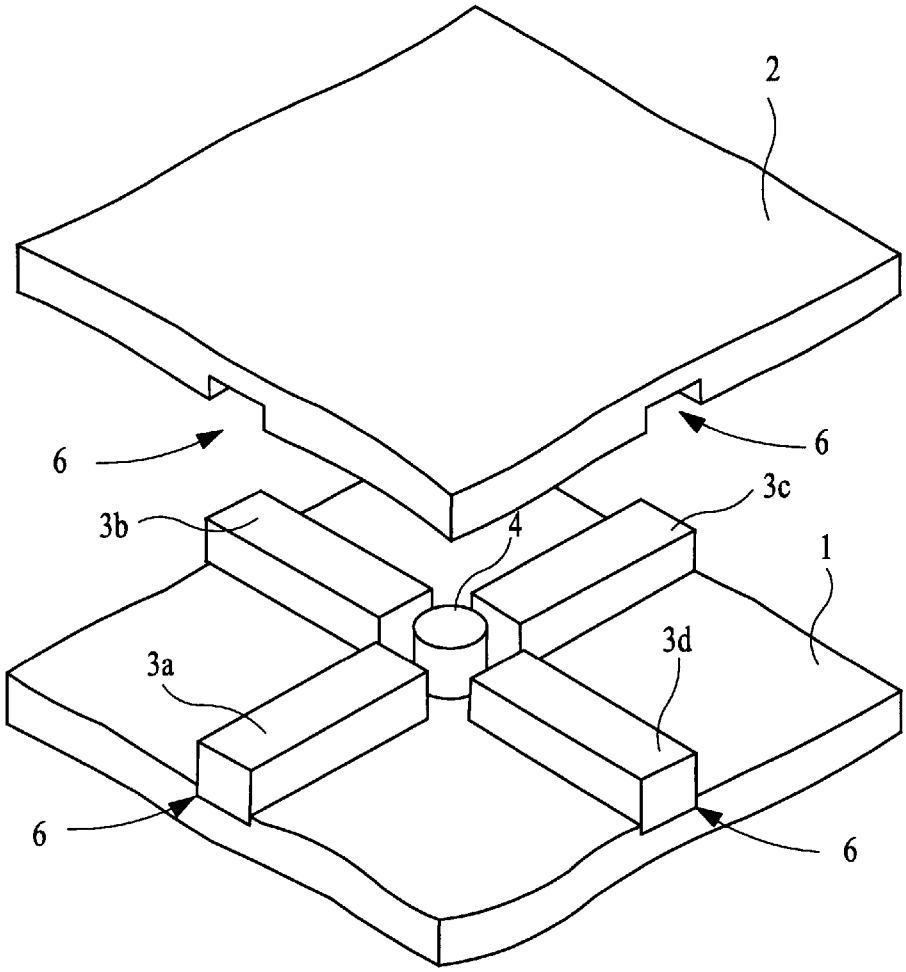
FIG. 7A is an exploded perspective view illustrating the configuration of an intersect-line apparatus according to a second embodiment of the present invention.
Figure 7B:
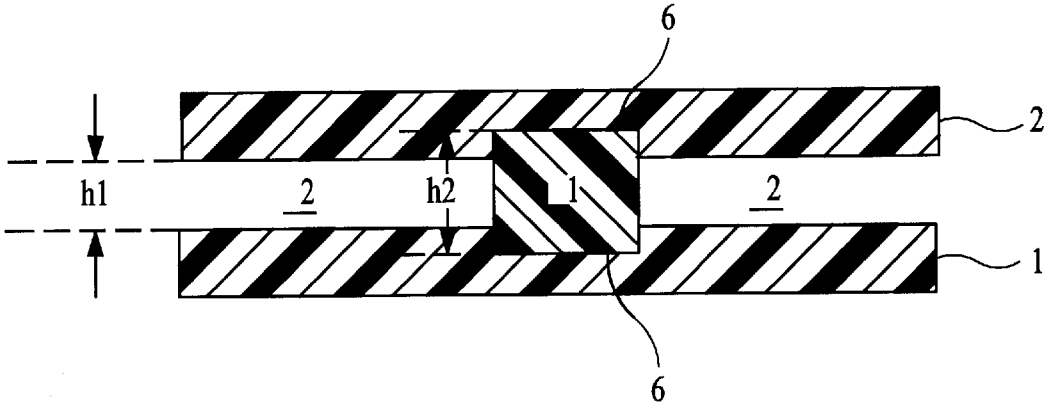
FIG. 7B is a cross-sectional view of the second embodiment.

The configuration of an intersect-line apparatus according to a second embodiment of the present invention is explained below with reference to the exploded perspective view of FIG. 7A. The second embodiment differs from the first embodiment in that the intersect-line apparatus is formed by dielectric lines in which signals are transmitted only in a single mode, i.e., in the $LSM_{01}$ mode, thereby eliminating the need to provide LSE-mode suppressors. More specifically, grooves 6 for receiving the dielectric strips 3*a* through 3*d* are formed, as illustrated in FIG. 7A, in the internal surfaces of the upper and lower conductor plates 1 and 2. Thus, the spacing between the conductor plates 1 and 2 in a non-propagating region outside the area where the dielectric strips 3*a* through 3*d* are provided is made narrower than the spacing between the conductor plates 1 and 2 in a propagating region where the dielectric strips 3*a* through 3*d* are placed. Referring to the cross-sectional view in FIG. 7B, the spacing in the non-propagating region is indicated by h1, while the spacing in the propagating region is represented by h2. The dielectric constant of the dielectric strips 3*a* through 3*d* is indicated by $\epsilon$1, while the dielectric constant of a dielectric member (normally air) between the conductor plates 1 and 2 in the non-propagating region is represented by $\epsilon$2. Then, the respective spacings h1 and h2 and the respective dielectric constants $\epsilon$1 and $\epsilon$2 are determined so that the cut-off frequency of the $LSM_{01}$ mode propagating in the propagating region is lower than the cut-off frequency of the $LSE_{01}$ mode, and that the $LSM_{01}$ mode and the $LSE_{01}$ mode electromagnetic waves are both blocked in the non-propagating region. Thus, dielectric lines in which only single-mode electromagnetic waves, i.e., the $LSM_{01}$-mode electromagnetic waves, propagate are constructed. Accordingly, in FIG. 7A, when an $LSM_{01}$-mode electromagnetic wave propagates in the dielectric strips 3*a* and 3*c* via the dielectric resonator 4, an $LSE_{01}$-mode electromagnetic wave does not propagate in the dielectric strips 3*b* and 3*d*. Similarly, when an $LSM_{01}$-mode electromagnetic wave propagates in the dielectric strips 3*b* and 3*d*, an $LSE_{01}$-mode electromagnetic wave does not propagate in the dielectric strips 3*a* and 3*c*.

In the foregoing embodiments, the dielectric strips with end faces opposing the dielectric resonator are disposed linearly. It is only essential, however, that at least opposing portions of adjacent dielectric strips are spaced from each other substantially at 90°, and the portions other than the opposing portions may be bent to lead the dielectric strips to the exterior in any direction. Particularly in the second embodiment shown in FIG. 7A, since only the single mode electromagnetic waves, the $LSM_{01}$-mode electromagnetic waves, propagate in the dielectric lines, mode conversion from the $LSM_{01}$ mode to the $LSE_{01}$ mode is prevented even though the radius of curvature of the bent portion is made small, thereby enabling transmission with only small losses.

Figure 8:
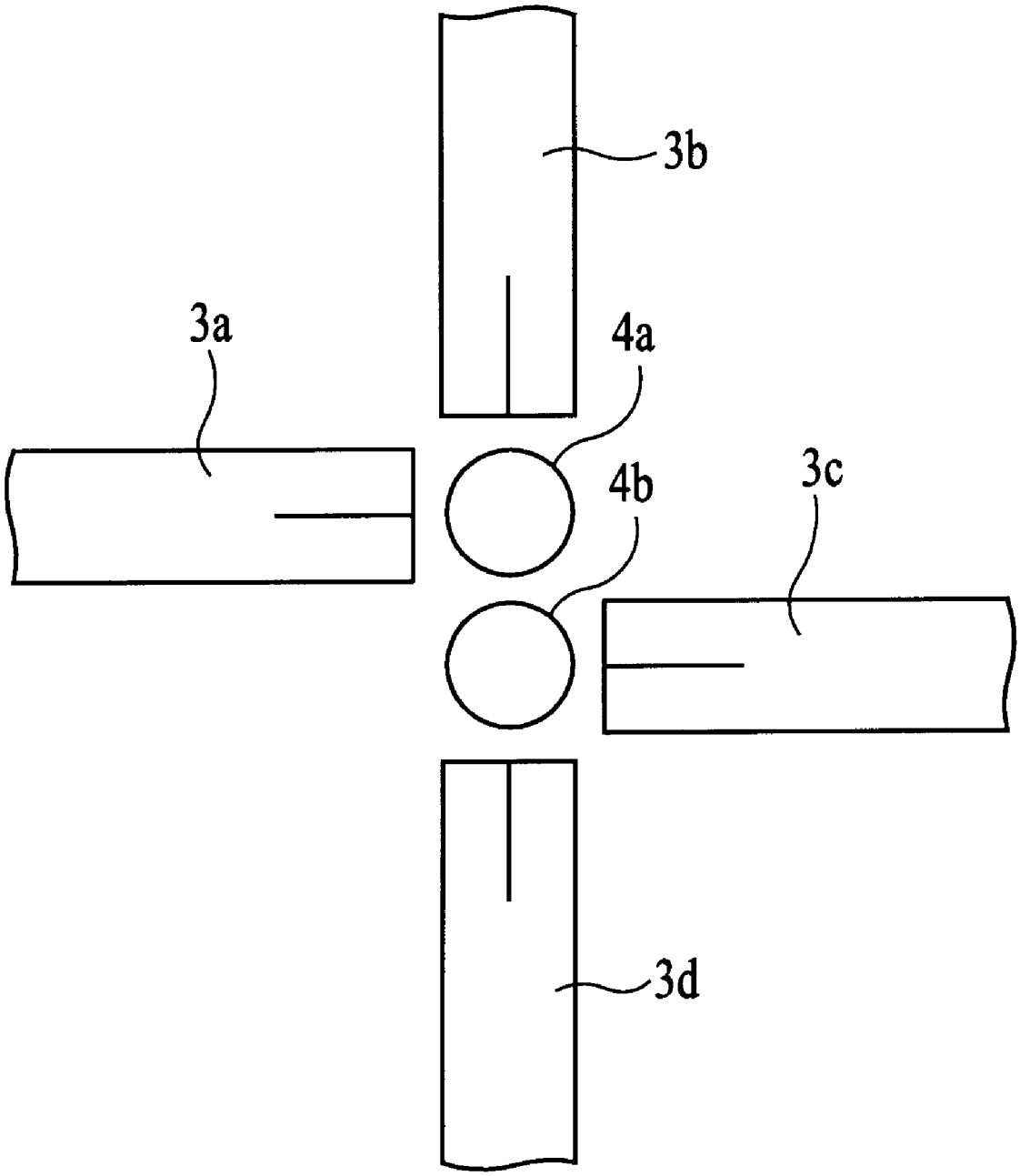
FIG. 8 is a plan view illustrating the configuration of an intersect-line apparatus according to a third embodiment of the present invention.

FIG. 8 is a plan view of an intersect-line apparatus according to a third embodiment of the present invention (the upper and lower conductor plates are not shown). Although in the foregoing embodiments, only a single dielectric resonator is used, a plurality of dielectric resonators may be used to form an intersect-line apparatus. In the third embodiment illustrated in FIG. 8, dielectric resonators 4*a* and 4*b* resonating in the HE mode are used. Dielectric strips 3*b* and 3*d* are disposed in the direction in which the dielectric resonators 4*a* and 4*b* are arranged, and dielectric strips 3*a* and 3*c* are located at 90° with respect to the above direction to opposedly face the dielectric resonators 4*a* and 4*b*, respectively.

Figure 9A:
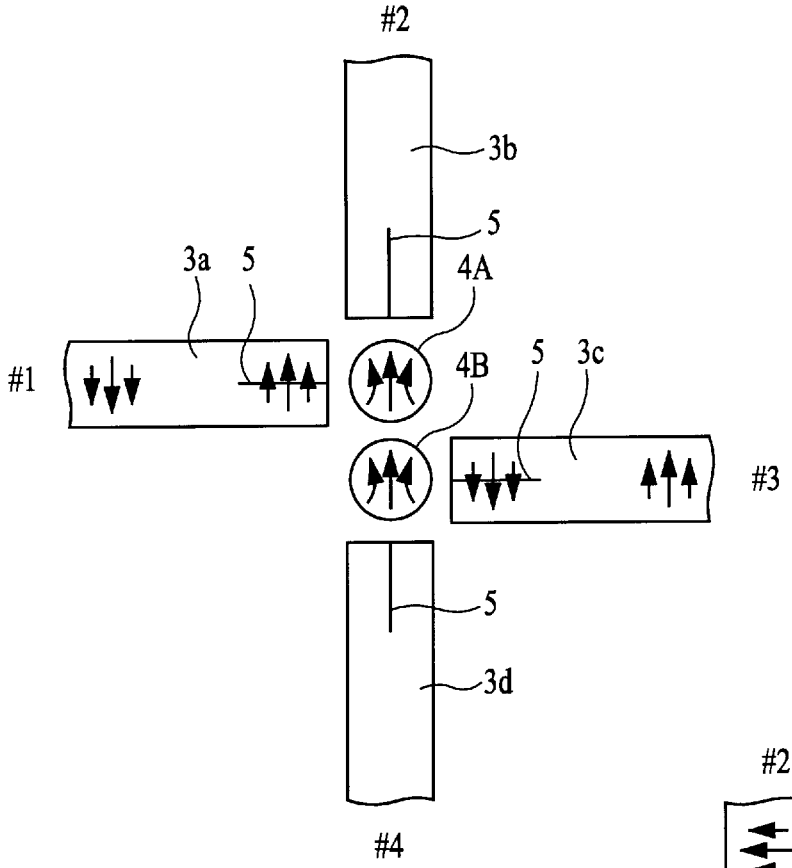
FIGS. 9A and 9B illustrate the coupling state between the dielectric strips and a dielectric resonator used in the intersect-line apparatus shown in FIG. 8.
Figure 9B:
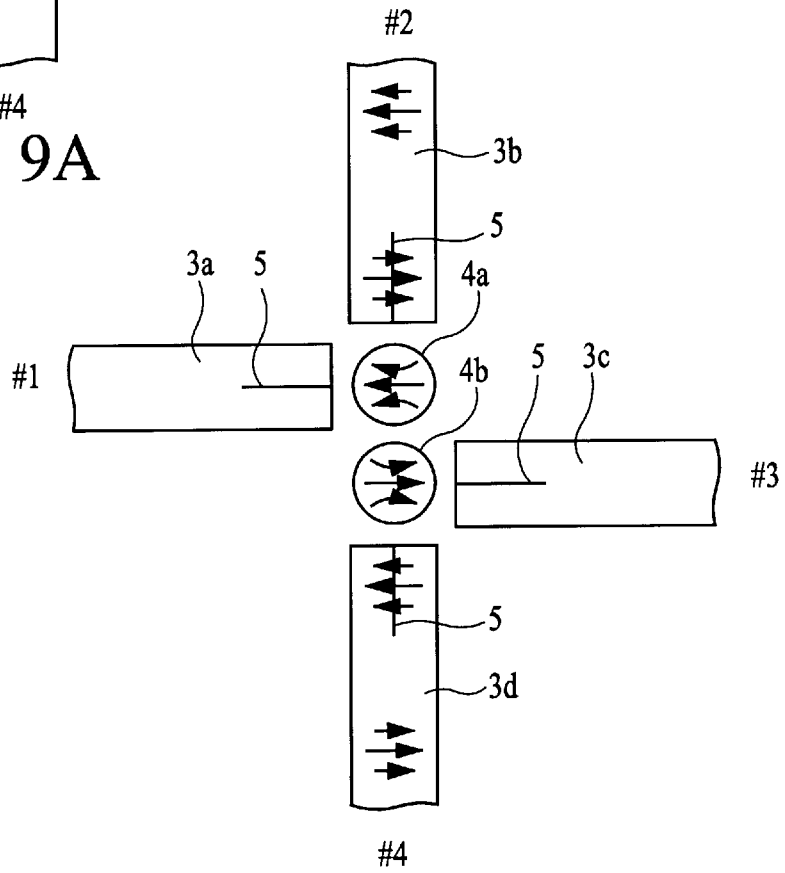

FIGS. 9A and 9B illustrate the coupling state between the dielectric strips 3*a* through 3*d* and the dielectric resonators 4*a* and 4*b* in the intersect-line apparatus shown in FIG. 8. For example, when an $LSM_{01}$-mode electromagnetic wave is incident on the dielectric strip 3*a* from a port #1, as illustrated in FIG. 9A, the dielectric resonator 4*a* is excited in the $HE_{111}$ mode, which is magnetically coupled to the dielectric resonator 4*b*, thereby also exciting the dielectric resonator 4*b* in the $HE_{111}$ mode. The dielectric resonator 4*b* is then magnetically coupled to the dielectric strip 3*c*, thereby outputting an $LSM_{01}$-mode electromagnetic wave to a port #3. At this time, LSE-mode suppressors 5 provided for the dielectric strips 3*b* and 3*d* suppress the LSE-mode signals from propagating in the dielectric strips 3*b* and 3*d*. Conversely, when an $LSM_{01}$-mode electromagnetic wave is incident on the dielectric strip 3*b* from a port #2, as shown in FIG. 9B, the dielectric resonator 4*a* is excited in the $HE_{111}$ mode, which is magnetically coupled to the dielectric resonator 4*b*, thereby also exciting the dielectric resonator 4*b* in the $HE_{111}$ mode. The dielectric resonator 4*b* is magnetically coupled to the dielectric strip 3*d*, thereby outputting an $LSM_{01}$-mode electromagnetic wave to a port #4. At this time, LSE-mode suppressors 5 provided for the dielectric strips 3*a* and 3*c* prevent the $LSE_{01}$-mode signals from propagating in the dielectric strips 3*a* and 3*c*.

In this manner, two-stage dielectric resonators intervene between the dielectric lines in each intersecting direction, thereby increasing the pass bandwidth characteristics.

Figure 10:
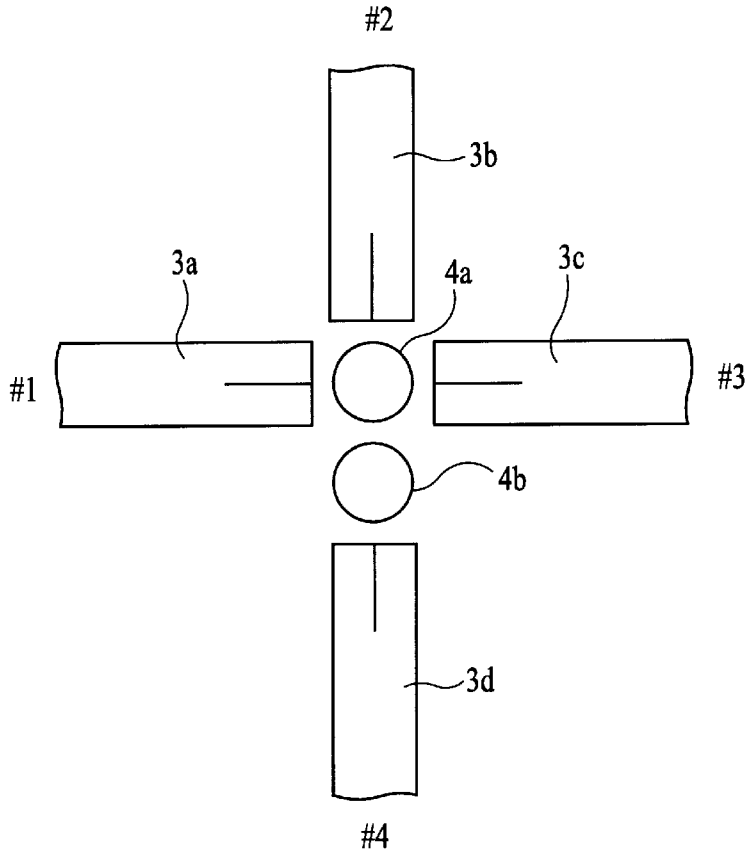
FIG. 10 is a plan view illustrating the configuration of an intersect-line apparatus according to a fourth embodiment of the present invention.

FIG. 10 is a plan view illustrating an intersect-line apparatus according to a fourth embodiment of the present invention (the upper and lower conductor plates are not shown). The fourth embodiment is different from the third embodiment illustrated in FIGS. 8 and 9 in that the dielectric strip 3*c* faces the dielectric strip 3*a* with the dielectric resonator 4*a* therebetween. In the fourth embodiment, only a single dielectric resonator 4*a* is interposed between the ports #1 and #3, while the two dielectric resonators 4*a* and 4*b* are interposed between the ports #2 and #4. It is thus possible to differentiate the pass bandwidth characteristics of the dielectric lines in the intersecting directions.

Figure 11:
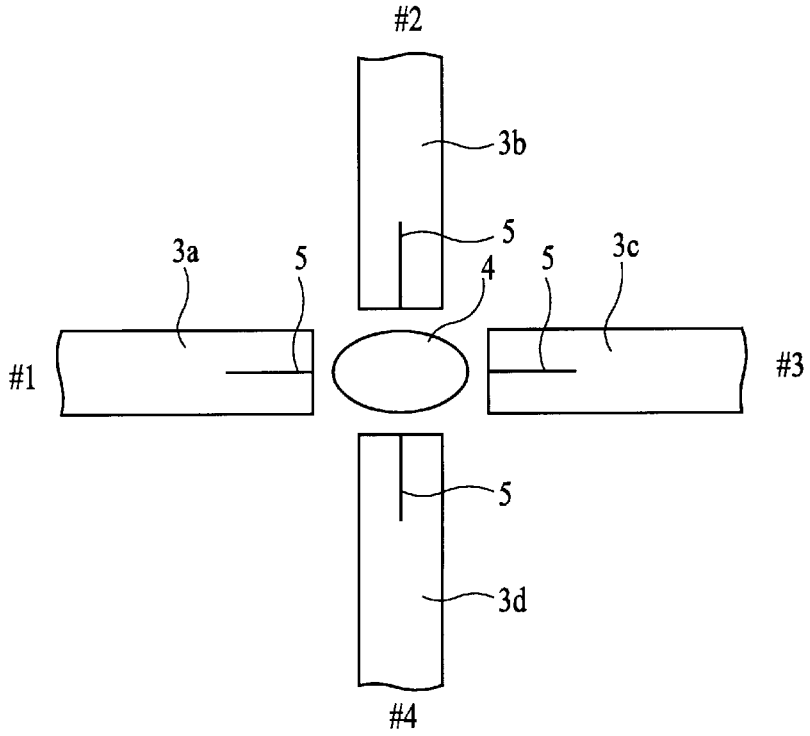
FIG. 11 is a plan view illustrating the configuration of an intersect-line apparatus according to a fifth embodiment of the present invention.
Figure 12:
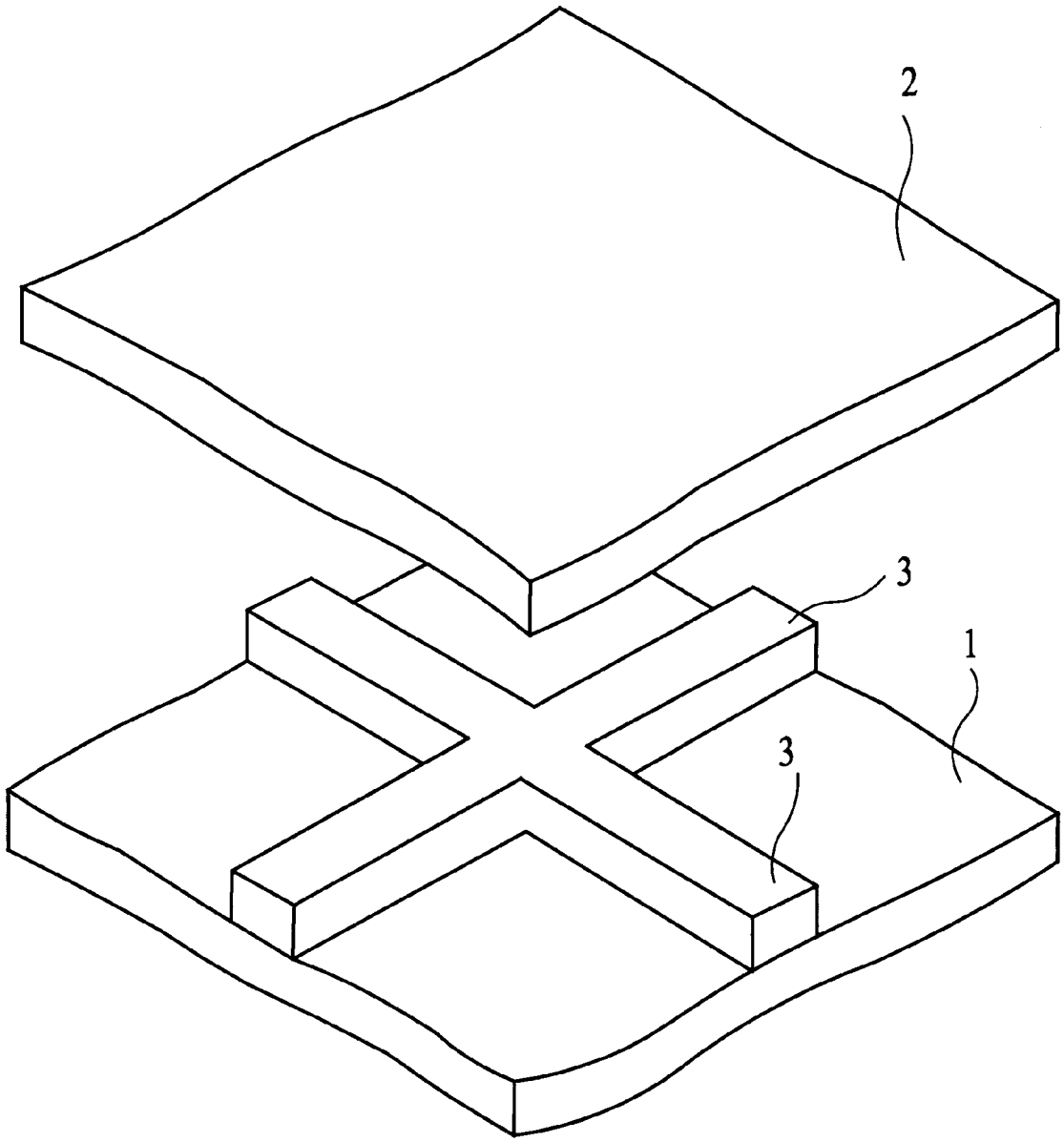
FIG. 12 PRIOR ART
FIG. 12 is an exploded perspective view illustrating an example of the configuration of a known intersect-line apparatus.

FIG. 11 is a plan view illustrating the configuration of an intersect-line apparatus according to a fifth embodiment of the present invention (the upper and lower conductor plates are not shown). Unlike the foregoing embodiments, in the fifth embodiment, a dielectric resonator 4 formed in an elliptical prism shape, which is not rotationally symmetrical, is used, and dielectric strips 3*a* and 3*c* are located along the longer axis, while dielectric strips 3*b* and 3*d* are positioned along the shorter axis. In this case, the resonant frequency generated when an electromagnetic wave is excited from the port #1 or #3 is different from the resonant frequency produced when an electromagnetic wave is excited from the port #2 or #4. By utilizing the above different resonant frequencies, transmission characteristics with only small losses can be obtained even though there is a comparatively great difference between the frequencies of the signals transmitted in the two intersecting lines.

By using a cylindrical or tubular HE-mode dielectric resonator, as well as by the dielectric resonator formed in an elliptical prism shape in the fifth embodiment, the characteristics of the two intersecting lines may be differentiated by providing different gaps between the end faces of the dielectric strips and the dielectric resonator. For example, relatively large gaps are provided to deliberately increase transmission losses of the dielectric lines in either direction.

As is seen from the foregoing description, the present invention offers the following advantages.

An intersect-line apparatus having good isolation characteristics and small losses is constructed in the same plane with a simple structure.

Moreover, by providing LSE-mode suppressors, the propagation of an LSE-mode signal in the 90°-spaced intersecting dielectric strips can be suppressed, thereby preventing mode conversion between the two intersecting dielectric lines. Thus, the two intersecting dielectric lines are used as independent (isolated) lines.

Additionally, it is possible to prevent mode conversion between two intersecting dielectric lines without requiring LSE-mode suppressors under certain conditions. Thus, under these conditions too, the two intersecting dielectric lines are used as independent (isolated) lines.

What is claimed is:

1. An intersect-line apparatus comprising:

two conductor plates disposed substantially parallel to each other;

one HE-mode dielectric resonator or a plurality of HE-mode dielectric resonators coupled to each other disposed between said two conductor plates; and four dielectric strips with end portions facing said HE-mode dielectric resonator or a predetermined dielectric resonator of said plurality of dielectric resonators, the adjacent dielectric strips being spaced from each other at an angle of substantially 90 degrees.

2. An intersect-line apparatus according to claim 1, wherein an LSE-mode suppressor is provided for each of said four dielectric strips.

3. An intersect-line apparatus according to claim 1, wherein a spacing h1 between said two conductor plates in a propagating region where said dielectric strips are disposed, a spacing h2 between said two conductor plates in a non-propagating region outside the propagating region, a dielectric constant $\epsilon$1 of the propagating region, and a dielectric constant $\epsilon$2 of the non-propagating region are determined under conditions such that a cut-off frequency of an $LSM_{01}$-mode signal propagating in the propagating region is lower than a cut-off frequency of an $LSE_{01}$-mode signal, and that electromagnetic waves in the $LSM_{01}$ mode and the $LSE_{01}$ mode are interrupted in the non-propagating region.

4. An intersect-line apparatus according to claim 2, wherein said LSE-mode suppressors are disposed in the respective end portion of each of said dielectric strips.

5. An intersect-line apparatus according to claim 3, wherein said conductor plates comprise grooves, and said dielectric strips are accommodated in respective ones of said grooves.

6. An intersect-line apparatus according to claim 1, wherein said conductor plates comprise grooves, and said dielectric strips are accommodated in respective ones of said grooves.

7. An intersect-line apparatus according to claim 1, wherein said plurality of HE-mode dielectric resonators comprise two dielectric resonators, two of said dielectric strips are both electromagnetically coupled to a respective one of said dielectric resonators, and the other two of said dielectric strips are electromagnetically coupled to the other one of said dielectric resonators.

8. An intersect-line apparatus according to claim 7, wherein an LSE-mode suppressor is provided in the respective end portion of each of said dielectric strips.

9. An intersect-line apparatus according to claim 1, wherein said plurality of HE-mode dielectric resonators comprise two dielectric resonators, three of said dielectric strips are all electromagnetically coupled to a respective one of said dielectric resonators, and the fourth one of said dielectric strips is electromagnetically coupled to the other one of said dielectric resonators.

10. An intersect-line apparatus according to claim 9, wherein an LSE-mode suppressor is provided in the respective end portion of each of said dielectric strips.

11. An intersect-line apparatus according to claim 1, wherein said one HE-mode dielectric resonator is shaped as an elliptical prism.

12. An intersect-line apparatus according to any one of claims 1, 3, 5, and 6, wherein each said dielectric resonator is shaped as a solid cylinder.

13. An intersect-line apparatus according to any one of claims 1, 3, 5 and 6, wherein each said dielectric resonator is electromagnetically coupled to the respective end portion of each corresponding dielectric strip.

* * * * *